US006082395A

United States Patent [19]

Balint

[11] Patent Number: 6,082,395

[45] Date of Patent: Jul. 4, 2000

[54] FLUID FLOW REGULATOR

[76] Inventor: Zoltan Balint, 565 Keilor Road, Niddrie, Victoria, Australia, 3042

[21] Appl. No.: 09/185,480

[22] Filed: Nov. 3, 1998

[30] Foreign Application Priority Data

Aug. 21, 1998 [AU] Australia ..... PP5423

[51] Int. Cl.[7] ..... F16K 3/22

[52] U.S. Cl. ..... 137/382; 251/145; 15/421

[58] Field of Search ..... 137/382, 625.41; 251/145; 15/375, 421

[56] References Cited

U.S. PATENT DOCUMENTS 2,176,139 10/1939 Lofgren ..... 251/145
4,725,352 2/1988 Haliotis .
5,338,446 8/1994 Schuman et al. .
5,836,345 11/1998 Ericson ..... 137/382

FOREIGN PATENT DOCUMENTS 2815196 10/1979 Germany ..... 15/421

*Primary Examiner*—John Fox
*Attorney, Agent, or Firm*—Greer, Burns & Crain, Ltd.

[57] ABSTRACT

A fluid flow regulator for regulating flow in tubes of vacuum or blower systems is disclosed. The regulator has a body formed by shaping interconnecting first and second body parts that are movable relative to one another wherein in one position flow is allowed only through an inner conduit and in a second position allowing fluid to flow into or out of a secondary opening to regulate the flow along the inner conduit and a cage like guard surrounding the connection of the first and second body parts.

14 Claims, 5 Drawing Sheets

FLUID FLOW REGULATOR

FIELD OF THE INVENTION

This invention relates to a fluid flow regulator especially for regulating flow in tubes of vacuum or blower systems.

It is particularly advantageous in the use of vacuum systems for swimming pool cleaning but it is not limited to such use.

BACKGROUND OF THE INVENTION

In domestic household vacuum systems, the tubes leading from the suction generator may include a flow regulator. Such regulators are usually in the form of a secondary tube opening that allows fluid flow into the opening and along the primary flow of the tube. This limits the tubular fluid flow from the end of the vacuum tube. This avoids changing adherence of the end of the vacuum tube against a surface, as it cannot be removed due to the strength of the suction force. The regulator also allows for gentle vacuuming when used over delicate materials or fibrous materials. The regulator also provides a safety element in case the tube becomes adhered to a person or pulls the hair or other extremity of people, and particularly children.

Generally such flow regulators comprise complex mechanisms of slide elements together with springs and the like. They are therefore a costly element and usually built into the tube and cannot be later inserted. Further they often do not provide much protection in preventing fingers or materials from entering the side opening and causing damage to the person, material or the machine.

With regard to swimming pool vacuum systems, U.S. Pat. No. 5,338,446 shows a filter unit able to receive a cartridge type filter element or be adapted so that the housing receives a strainer basket in place of the filter cartridge so as to serve as a conventional lift trap or skimmer on the top of the water. Such a structure allows for filtration by side entry of the material but has a filtration structure primarily aimed for the surface of water. It therefore skims the top water for the leaves and provides a filtering system. However, it does not provide any flow regulation and by acting as a filter easily gets clogged by leaves or other matter so as not to be able to provide a flow regulation. It is also structured to only be able to float on the surface.

U.S. Pat. No. 4,725,352 discloses a regulator for a swimming pool but only for a vacuum skimmer system. Further the regulator is attached to the swimming pool skimmer well that is in a closed well section next to the pool or next to the filtration or vacuum system. Due to its being integral with the skimmer well and away from the swimming pool water and only being relevant to the skimmer, it is very difficult to access, very difficult to regulate, and is specific to particular swimming pool skimmer wells. It also does not provide any safety measures with regard to protection of the skimmer regulator.

SUMMARY OF THE INVENTION

It is an object of the invention to provide an improved flow regulator that has a simple operation and eliminates the need for a multitude of inter-fitting parts.

In accordance with the invention there is provided a fluid flow regulator for regulating flow in tubes of suction or blower systems, such as vacuum or filtering machines, having a body with an inner continuous conduit extending therethrough and connectable to a vacuum or blower system, the inner continuous conduit and regulator body formed by first and second body parts which are movable relative to each other from a first position to a second position; wherein in the first position the first and second body parts are relatively positioned and fit together to allow substantially only flow along the inner conduit, and in the second position the first and second body parts are relatively positioned and fit to form a side opening feeding to the inner conduit and allowing fluid to flow into or out of the side opening to regulate the flow along the inner conduit; the regulator further including a guard extending from the first and second body parts and surrounding the connection of the first and second body parts and the side opening when in at least the second position, the guard having openings sized to prevent finger insertion and sized relative to the size of the side opening to allow suitable safe flow of fluid passing through the side opening when in use.

The guard may be integral with the regulator body and may be formed in two parts. A guard part extends from each of said first and second body parts and have complementary connection means on each allowing connection of the first and second body parts and allowing movement between the first and second positions while maintaining a protective guard over the connection of the first and second body parts and the side opening in at least the second position.

The fluid flow regulator may have, when connected, the first body part overlapping the second body part each with respective cut-outs such that in the first position the first body part overlaps the second body part and the cut-outs are relatively positioned so that the inner conduit is substantially sealed and fluid flow can occur along the inner conduit; and by relative movement of the first and second body parts the cut-outs are relatively positioned to form the side conduit feeding into the inner conduit and allowing fluid flow through the side opening into or out of the inner conduit.

In one form, the relative movement of the first and second body parts can be by rotational movement.

The connection means of the first and second body parts can comprise shaped projections on the guard part of one body part fitting over a rim of the other guard part on the other body part to allow a connection of the two body parts while allowing rotational relative movement of the two body parts. The connection may be a resilient locking system.

The regulator body may further include a relative movement limiting element wherein one part of the guard on one body part is formed by spaced ribbing and the limiting element is mounted on the other body part and when the two body parts are connected by the connector means the limiting element can engage one of a plurality of ribs of the spaced ribbing of the guard so as to provide various open positions of the side opening to vary the size of the side opening. The regulator body may further include locking means for selectively locking the relative positions of the first and second body parts resulting in a particular sized side opening providing a particular flow regulation.

BRIEF DESCRIPTION OF THE DRAWINGS

In order that the invention is more readily understood, a particular embodiment thereof will now be described by way of example only with reference to the accompanying drawings wherein.

DETAILED DESCRIPTION OF A PREFERRED EMBODIMENT

Figure 1:
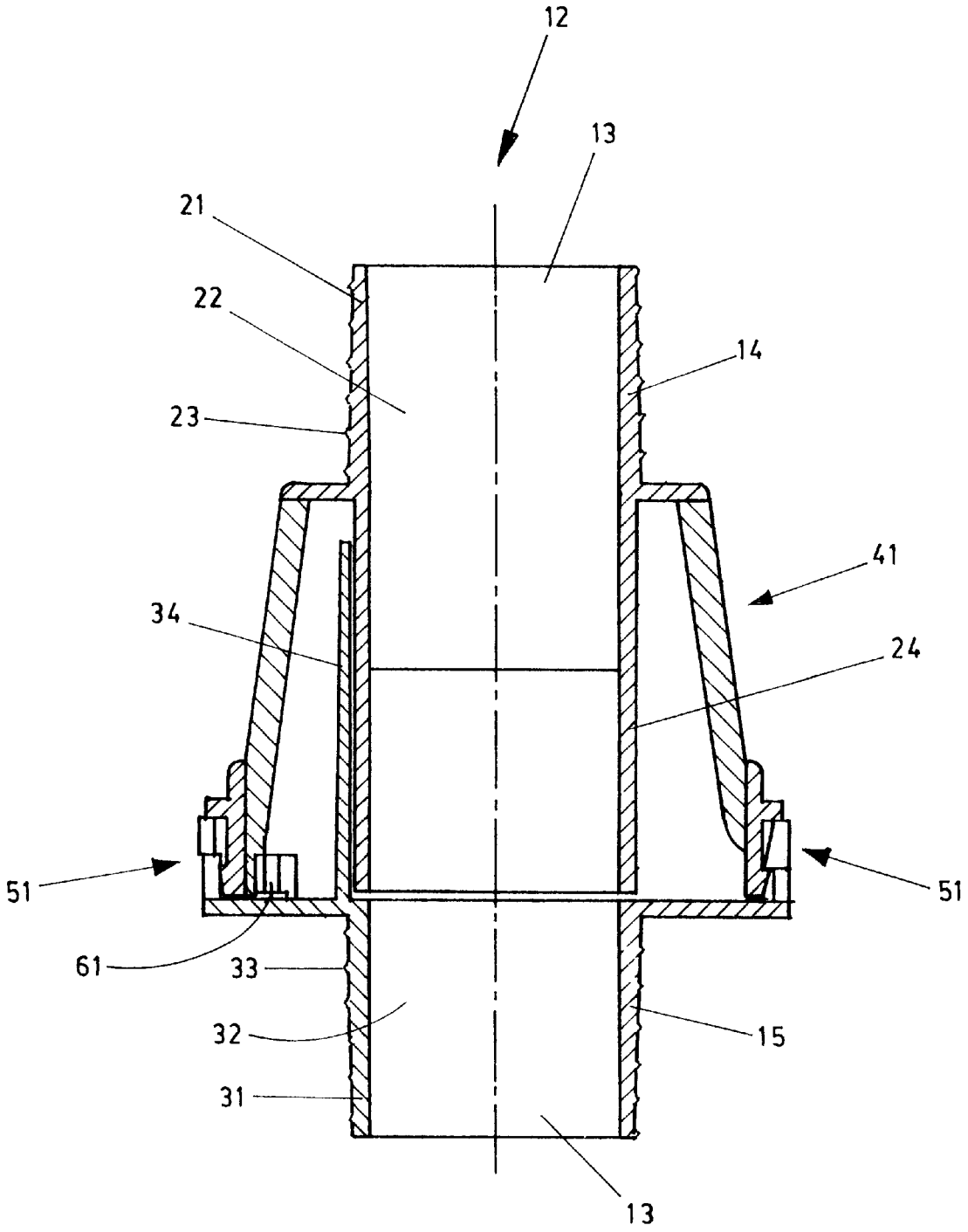
FIG. 1 is a sectional view of a fluid flow regulator according to a first embodiment of the invention.
Figure 2:
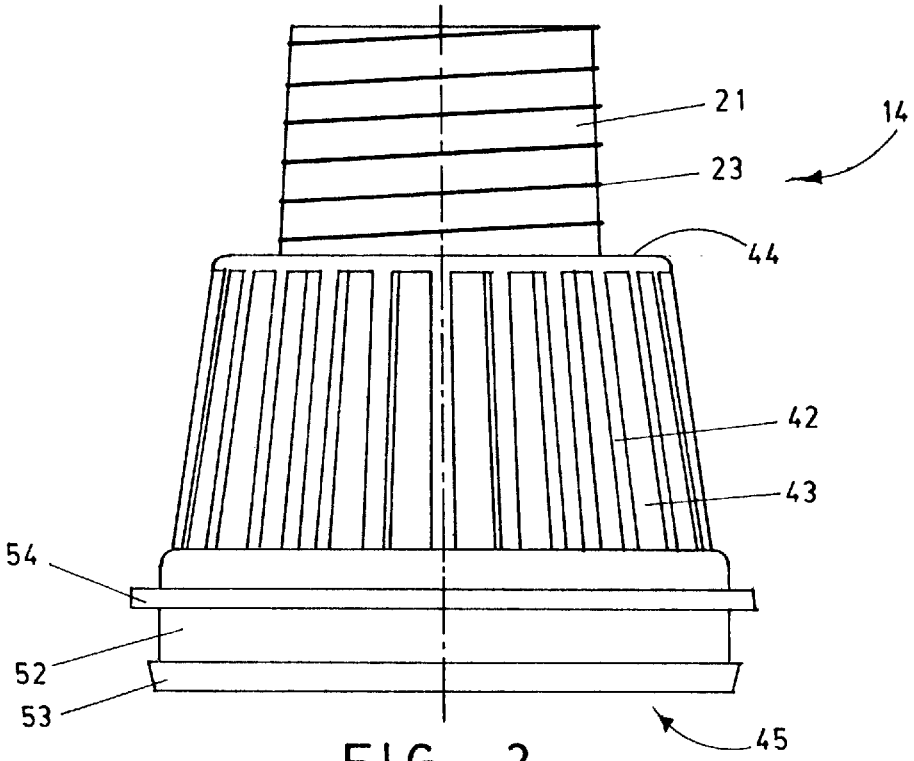
FIG. 2 is a side elevation of a first body part of the regulator of FIG. 1.
Figure 3:
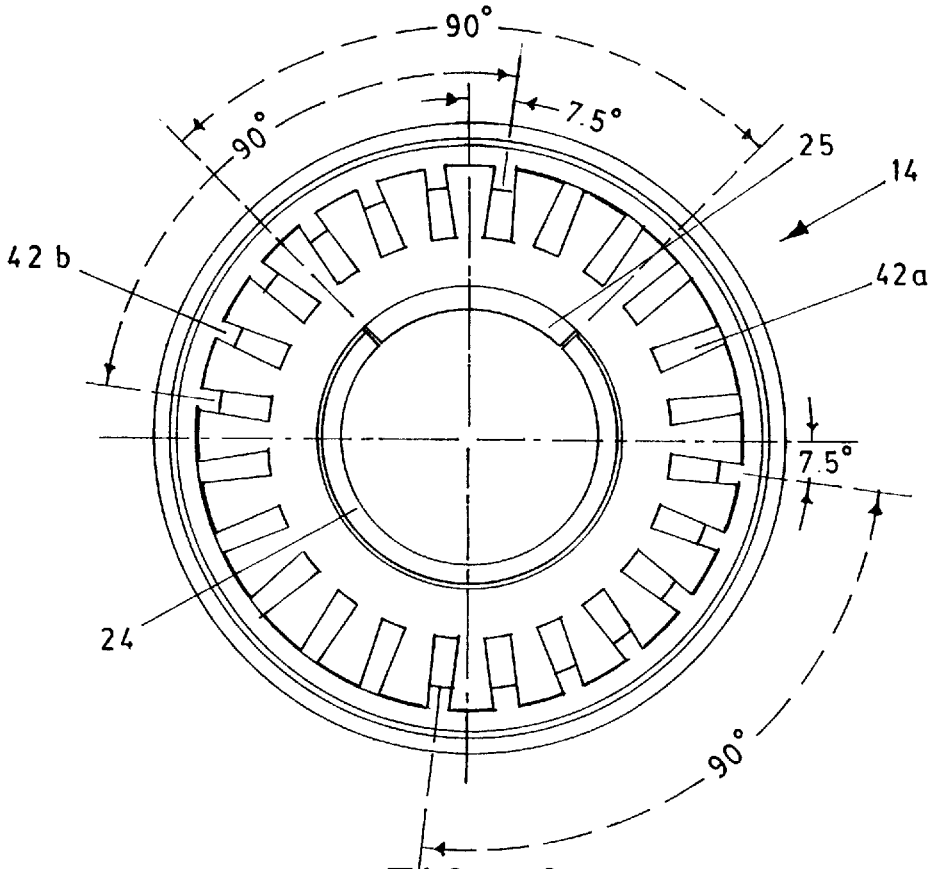
FIG. 3 is an underneath view of the first body part of FIG. 2.
Figure 4:
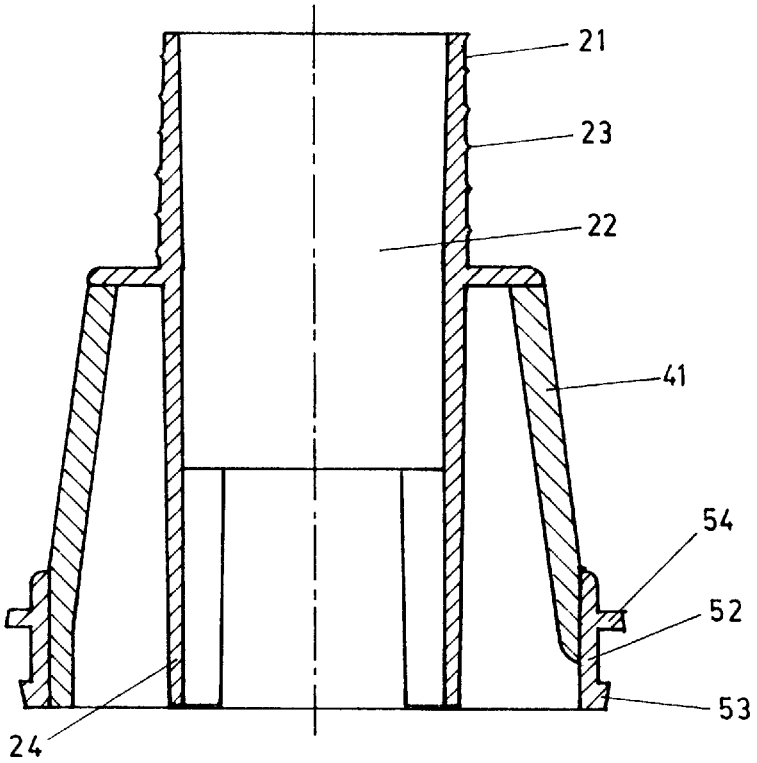
FIG. 4 is a sectional view of the first body part of FIG. 2.
Figure 5:
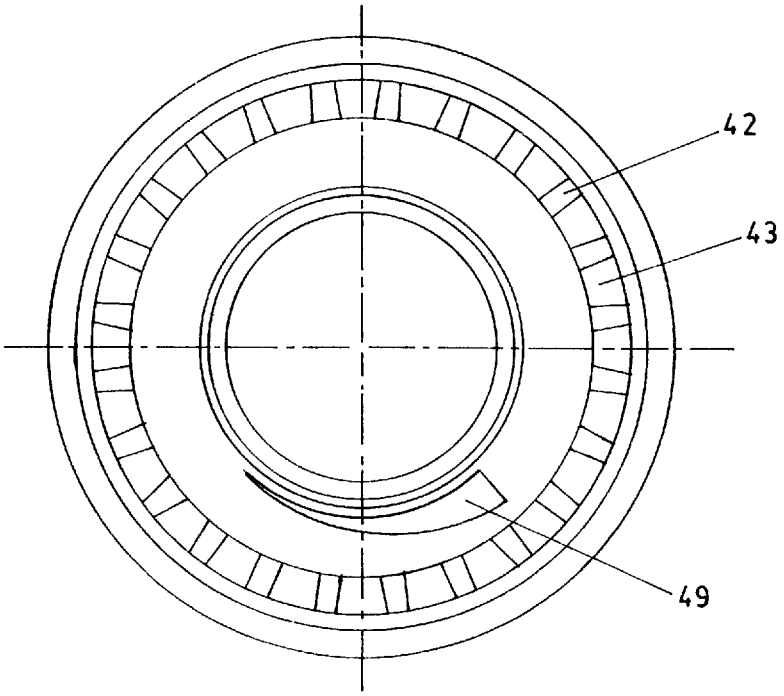
FIG. 5 is an overhead plan view of the first body part of FIG. 2.
Figure 6:
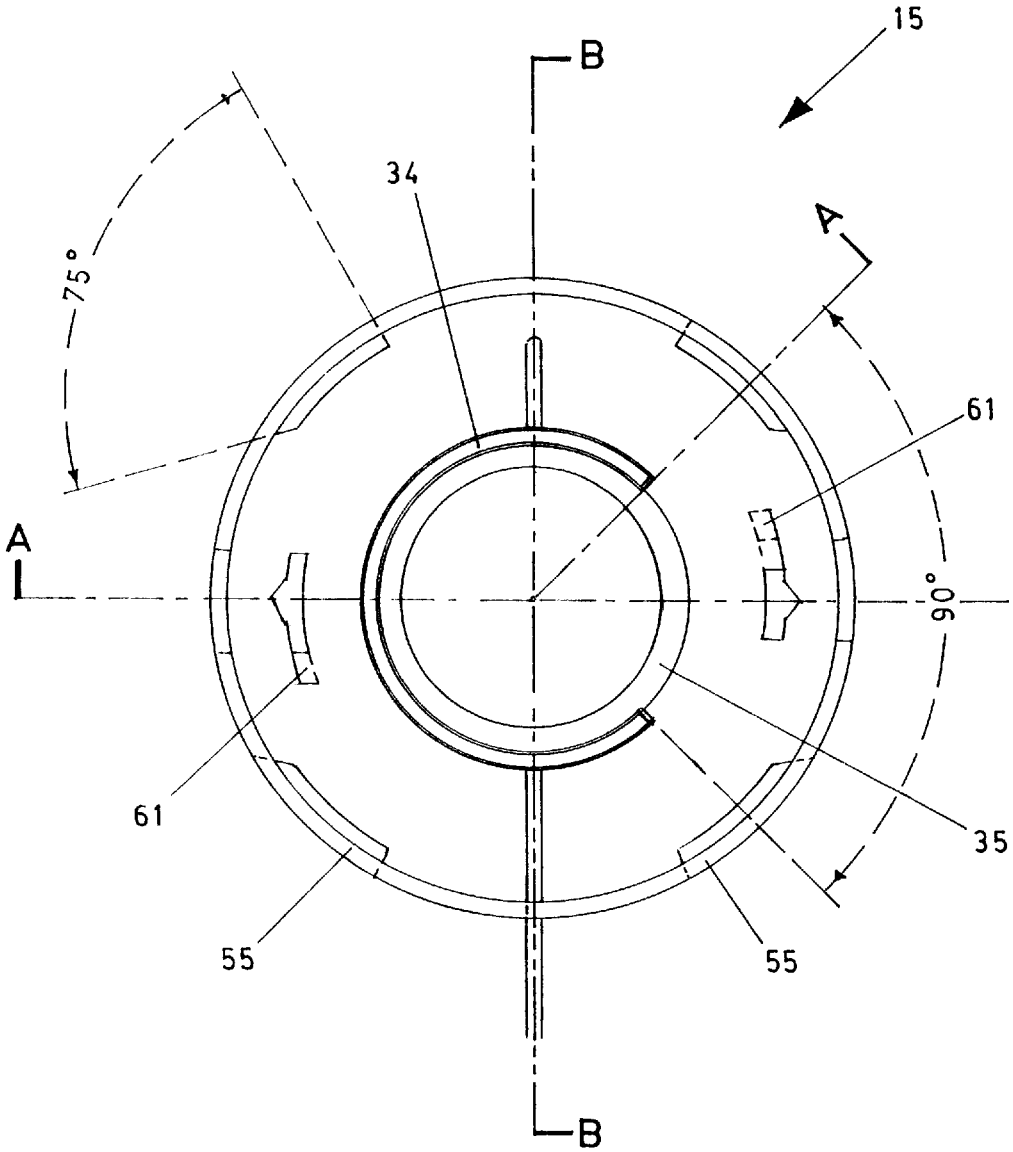
FIG. 6 is an overhead plan view of the second body part of FIG. 1.
Figure 7:
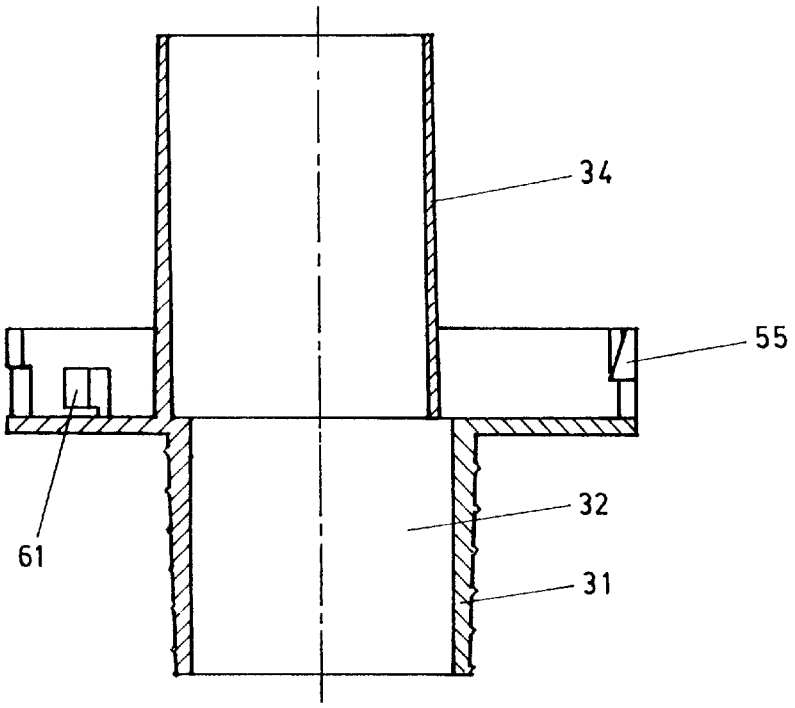
FIG. 7 is a sectional view of the second body part of the regulator of FIG. 6 along A—A.
Figure 8:
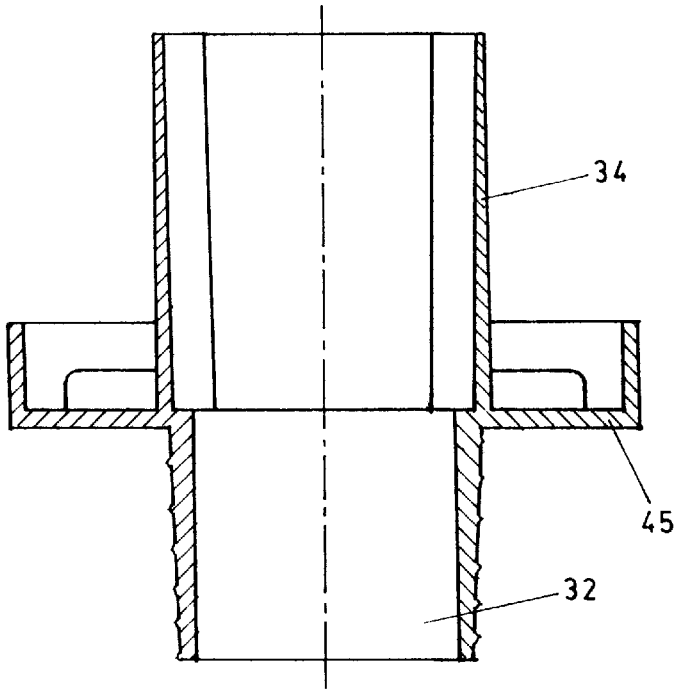
FIG. 8 is a sectional view of the second body part of the regulator of FIG. 6 along B—B.

Referring to the drawings there is shown a fluid flow regulator according to one embodiment of the invention. The fluid flow regulator is connectable to a vacuum or blower system for regulating flow in tubes of vacuum or blower systems and having a regulator body 12 formed by shaped interconnecting first and second body parts 14, 15 each forming part of a cylindrical inner continuous conduit 22, 32 that can be connected in alignment to form a continuous inner conduit 13 extending therethrough.

The substantially cylindrical first body part 14 has a cylindrical inner body 21 forming the part of the inner continuous conduit 22 extending from one end to the other. At a first end is an external thread 23 for connection to a tube of a vacuum or blower system. At the other interconnecting end of the cylindrical body 21 is a first body part overlap 24 that is also substantially cylindrical but does not have external thread and forms about two thirds of the length of the entire cylindrical part of the first body part 14. Similarly the second body part 15 has a substantially cylindrical body 31 which at a first end has an external thread 33 for connection to another part of the tube of the vacuum or blower system and has an inner conduit 32 forming another part of the continuous conduit 22 and extending from one end to the other. At the other end of the second body part 15 is a second body part overlap 34 forming about two thirds of the length of the second body part 15 and not including any external threads.

The first and second body parts 14, 15 further include parts of guard 41 around the cylindrical bodies 21, 31 that are substantially different. These are discussed further later.

The overlapping second body part 34 overlaps the first body part overlap 24 by the second cylindrical body part having an inner conduit 32 diameter slightly larger than the outer diameter of the overlapped first cylindrical body part 24. Each of the first and second body parts 14, 15 at their respective overlaps 24, 34 have a cut-out 25, 35 of about a quarter of the end circumference.

The first and second body parts 14, 15 are rotationally movable relative to each other from a first position to a second position. In the first position the second body 15 part overlaps the first body part 14 and the cut-outs 25, 35 are relatively positioned such that the inner conduit 13 is substantially sealed and fluid flow can substantially only occur along the inner conduit 13. By relative rotational movement of the first and second body parts 14, 15 the cut-outs 25, 35 are relatively aligned to form a secondary side opening 19 feeding into the inner conduit 13 and allowing fluid flow through the side opening into or out of the inner conduit 13.

The regulator further includes a guard 41 having a first and second part with the first part of the guard being cage-like and comprising an array of substantially parallel ribbing 42 interspersed by similar dimensional openings 43 following a frusto conical shape coaxial with the inner continuous cylindrical conduit 22 and extending from a top disc 44 extending normal to the cylindrical first body part 21 to an open circular end 45 parallel to the top disc 44 but of larger dimension. The circular end 45 of the first part of the guard extends just beyond the longitudinal end of the cylindrical first body part 14 having the cut-out 24. The first part of the guard 41 is formed integrally with the first body part 14.

The second part of the guard 41 is formed integrally on the second body part 15 and includes an L-shape cross-section rimmed disc 45. A part of the disc 45 extends radially along a plane normal to the cylindrical body part 31 and connects an upper raised rim of the L-shape rimmed disc 45 extending parallel to the axis of rotation of the inner conduit 32 of the second body part 15 and extending parallel to the second body part overlap 34. A connection means 51 on the first body part 14 comprises an outer annular upper lip 54 and spaced annular lower lip 53 with a cylindrical portion 52 having a smaller diameter therebetween. The extension of the disc 45 is sufficient to extend beyond a portion of the connection means 51 on the first body part 14 when the first and second body parts 14, 15 are co-axially aligned.

On the L-shape disc 45 of the second body part are inwardly facing connection projections 55 extending from the inner surface of the lip of the second guard part 45 shaped and positioned to allow fitting within the annular upper lip 54 and annular lower lip 53 of the first body part 14 and thereby interconnecting the first and second body parts 14, 15. The connection projection 55 can smoothly slide along the smooth cylindrical portion 52.

Thereby the connection means of the first and second body parts comprise shaped projections 55 on the guard part of one body part fitting over the annular lower lip 53 of the other guard part on the first body 14 part to allow a resilient connection of the two body parts 14, 15 while allowing rotational relative movement of the two body parts 14, 15.

When the two body parts 14, 15 are connected, one part of the guard 41 extends from a middle outer part of the cylindrical part of the first body part 41 over the cut-out end and surrounds the connection of the first and second body parts 14, 15 and the side opening 19 when in the second position. The openings 43 in the guard 41 sized to prevent finger insertion and sized relative to the size of the side opening 19 to allow suitable safe flow rate of fluid passing through the side opening when in use.

The integral connection means 51 on each of the parts of the guard 41 allow connection of the first and second body parts 14, 15 while allowing movement between the first and second positions and maintaining a protective guard over the side opening 19 in at least the second position but in this embodiment providing a protective guard in all connected positions.

The ribbing 42 includes twenty-four separate ribs which are either extended ribs that extend on the innerside from the upper disc 44 to the opening 45 of the first body part and a second group of ribs **42*b* which are shortened ribs that extend from the upper disc 44 to an inner position corresponding with the smooth cylindrical portion 52 of the connection means 51 and spaced from the ending the height of the relative movement limiting element 61. The outer parts of the ribbing 42 are continuous to form the cage-like guard 41 while the inner parts of the ribbing vary in their inner projections to form extended ribs 42*a* and foreshortened ribs 42*b*. The twenty-four ribs are in a grouping of seven extended ribs 42*a*** followed by five foreshortened ribs

42*b* followed by a further seven extended ribs 42*a* and the final five are foreshortened ribs 42*b*.

The regulator body further includes a relative movement limiting element 61 mounted on the upper circular part of the L-shape lip guard disc 55 on the second body part 15. The limiting element 61 is a shaped wedge located inward of the outer rim of the L-shape disc 45 and facing outwardly so as to engage a lower portion of the spaced extended ribs 42*a* of the guard part 51 on the first body part. When the two body parts 14, 15 are connected by the connector means 51 the limiting element 61 can engage one of a plurality of extended ribs 42*a* of the spaced ribbing of the guard 41 to provide various open positions of the side opening and vary the size of the side opening 19.

Duplicate relative movement limiting element 61 is fixed at diametrically opposite position on the second guard part 45. The limiting elements 61 are able to engage opposite positioned extended ribs 42*a* and provide a selection of seven fixed positions in between the first position and the second position of the relative positions of the first and second body parts. In this way, there are seven possible opening positions of the side opening 19 able to provide a discrete number of gradually larger openings of the resultant side opening.

The invention provides full control of the flow rate along the inner continuous tube 13 by the control of the size and thereby the flow through the side opening 19. Further it can be seen that all parts are made on two separate moulded body parts 14 and 15 to minimise the number of components and to have a true inter-relationship between the connection means and the guard and the selective opening of the side opening 19.

It should be evident from the description hereinabove that the present invention provides an improved fluid regulator for regulating the flow in tubes of vacuum or blower systems that avoids most if not all the disadvantages of the prior art. For example the connection means may be externally fitted and there may be a variety of different number positions of the body parts as long as there is control of the size of the side opening. Further the opening may elsewhere than on the side.

The regulator body may further include a locking means for selectively locking the relative positions of the first and second body parts resulting in a particular sized side opening providing a particular flow regulation. This could be a locking element that slides between the ribbing and is able to engage or surround upper projections on the disc part of the guard on the second body part. In this way the locking element is manually slid into and out of locking position to allow or prevent relative rotation of the two body parts.

Of course many modifications to the above described embodiment may be readily envisaged by a person skilled in the art and are thereby included in the scope of the invention.

What I claim is:

1. A fluid flow regulator for regulating flow in tubes of suction or blower systems, having a regulator body formed by a plurality of body parts with interconnecting first and second body parts which are movable relative to each other from a first position to a second position; and in the first position the plurality of body parts form an inner continuous conduit connectable to a vacuum or blower system to allow substantially only flow through the inner conduit, and in the second position the first and second body parts are relatively positioned to form the inner conduit with a secondary opening feeding thereto allowing fluid to flow into or out of the secondary opening to regulate the flow along the inner conduit;

the regulator further including a cage-like guard extending from at least one of the plurality of body parts and substantially surrounding the connection of the first and second body parts and the opening when in at least the second position, the guard having openings sized to prevent finger insertion and sized relative to the size of the secondary opening to readily allow flow of fluid to pass through the opening when in use.

2. The regulator according to claim 1 wherein the guard is formed in two parts.

3. The regulator according to claim 2 wherein each guard part is integral with respective regulator body parts.

4. The regulator according to claim 2 wherein the guard parts extend from a respective one of said first and second body parts and have complementary connection means on each allowing connection of the first and second body parts and allowing movement between the first and second positions while maintaining a protective guard over the connection of the first and second body parts and the opening in at least the second position.

5. The regulator according to claim 4 wherein the first body part overlaps the second body part and each have cut-outs such that in the first position the first body part overlaps the second body part and the cut-outs are not aligned so that the inner conduit is substantially sealed and fluid flow can occur along the inner conduit; and by relative movement of the first and second body parts the cut-outs are at least partially aligned to form the conduit feeding into the inner conduit and allowing fluid flow through the opening into or out of the inner conduit.

6. The regulator according to claim 5 wherein the relative movement of the first and second body parts is by rotational movement.

7. The regulator according to claim 2 wherein the connection means of the first and second body parts comprises shaped projections on the guard part of one body part fitting over a rim of the other guard part on the other body part to allow a connection of the two body parts while allowing rotational relative movement of the two body parts.

8. The regulator according to claim 7 wherein the connection is a resilient locking system.

9. The regulator according to claim 6 wherein the regulator body further includes a relative movement limiting element wherein one part of the guard on one body part is formed by spaced ribbing and the limiting element is mounted on the other body part such that when the two body parts are connected by the connector means the limiting element can engage one of a plurality of ribs of the spaced ribbing of the guard so as to provide various sizes of open positions of the opening.

10. The regulator according to claim 1 wherein the regulator body further includes locking means for selectively locking the relative positions of the first and second body parts resulting in a particular sized opening providing a particular flow regulation.

11. The regulator according to claim 2 wherein the first and second body parts of the regulator body and the two parts of the guard are moulded as two interconnecting plastic parts.

12. The regulator according to claim 1 wherein the regulator body parts are formed to be suitable for use with an underwater swimming pool vacuum cleaning system for cleaning the pool surfaces.

13. A swimming pool surface cleaner in line vacuum regulator having a regulator body with two interconnectable body parts, each body part having a portion of an inner continuous conduit with one end able to be fitted to a vacuum hose and respective interconnecting ends having shaped cut-outs and wherein the body parts are movable relative to each other from a first to a second position such that in the first position fluid flow is substantially only along the inner continuous conduit while in the second position the interaction of the shaped cut-outs form a secondary opening feeding into the inner continuous conduit thereby allowing fluid to flow into or out of the secondary opening to regulate the flow along the inner conduit; each of the interconnectable body parts further having an integral portion of a cage-like guard such that in the second position the guard surrounds the connection of the first and second body parts and the opening, the cage-like guard having opening sides to prevent finger insertion and sides relative to the size of the secondary opening to readily allow the flow of fluid to pass through the opening when in use.

14. The swimming pool surface cleaner in-line vacuum regulator of claim 13 wherein the guard is cylindrical or frusto-conical and coaxial with the inner continuous conduit.

* * * * *

UNITED STATES PATENT AND TRADEMARK OFFICE

CERTIFICATE OF CORRECTION

PATENT NO. : 6,082,395
DATED : July 4, 2000
INVENTOR(S) : Zoltan Balint

It is certified that error appears in the above-identified patent and that said Letters Patent is hereby corrected as shown below:

Title page,
Item [56], "References Cited", insert the following Foreign Patents:

| | | |
|---|---|---|
| 0380421 | 08/1990 | EPO |
| 2729730-A1 | 01/1995 | France |

Signed and Sealed this

Eighteenth Day of December, 2001

*Attest:*

*Attesting Officer*

JAMES E. ROGAN
*Director of the United States Patent and Trademark Office*